US006901715B2

(12) United States Patent
Brown et al.

(10) Patent No.: US 6,901,715 B2
(45) Date of Patent: Jun. 7, 2005

(54) MODULAR RIM BOARD FOR FLOOR AND RAFTER SYSTEMS

(75) Inventors: Comer Brown, Boise, ID (US); Lawrence Brown, Boise, ID (US)

(73) Assignee: Silpro, LLC, Boise, ID (US)

( * ) Notice: Subject to any disclaimer, the term of this patent is extended or adjusted under 35 U.S.C. 154(b) by 8 days.

(21) Appl. No.: 10/376,556

(22) Filed: Feb. 27, 2003

(65) Prior Publication Data

US 2003/0159396 A1 Aug. 28, 2003

Related U.S. Application Data

(60) Provisional application No. 60/360,763, filed on Feb. 27, 2002.

(51) Int. Cl.[7] ..... E04C 3/02

(52) U.S. Cl. ..... 52/702; 52/289; 52/729.1; 52/92.3

(58) Field of Search ..... 403/230, 231, 403/331, 382; 52/289, 702, 656.9, 729.1, 92.1, 92.3, 93.1; 144/354, 198.1, 90.1; 748/223.41, 224.51

(56) References Cited

U.S. PATENT DOCUMENTS

| | | | | |
|---|---|---|---|---|
| 2,495,966 A | * | 1/1950 | Haines | 403/169 |
| 4,195,462 A | * | 4/1980 | Keller et al. | 52/690 |
| 4,514,104 A | * | 4/1985 | Taylor et al. | 403/14 |
| 4,815,242 A | * | 3/1989 | Gilliland | 52/93.1 |
| 4,893,961 A | * | 1/1990 | O'Sullivan et al. | 403/232.1 |
| 5,203,639 A | * | 4/1993 | Femrite | 403/382 |
| 5,285,612 A | * | 2/1994 | Johnson | 52/655.1 |
| 5,375,381 A | * | 12/1994 | Park et al. | 52/92.1 |
| 5,930,968 A | * | 8/1999 | Pullam | 52/481.1 |
| 6,301,854 B1 | * | 10/2001 | Daudet et al. | 52/650.1 |
| 6,318,029 B1 | * | 11/2001 | Huppunen | 52/105 |

FOREIGN PATENT DOCUMENTS

EP 1253256 A2 * 10/2002

OTHER PUBLICATIONS

Joist Pocket Liner™ brochure with explanation by Applicant's Agent, product shown at trade show in Autumn of 2001.

Trus Joist™ pamphlet showing building techniques with explanation by Applicant's Agent of Web Stiffener Attachement (p. 7 of pamphlet), Jul. 2001.

Connector Selection Guide by Boise Cascade Timber and Wood Products Division, Jun. 2000.

* cited by examiner

*Primary Examiner*—Anita King
*Assistant Examiner*—Jon Szumny
(74) *Attorney, Agent, or Firm*—Pedersen & Co., PLLC; Ken J. Pedersen; Barbara S. Pedersen

(57) ABSTRACT

An engineered perimeter rim board with machined or otherwise-formed modular recessed receptacles receives and secures I-joists and other manufactured joists at predesignated spaces along the length of the rim board. The rim board provides pre-measured joist securement locations and structural enhancements by "locking" the joists into position. Receptacles machined/cut into the rim board may be of various shapes, such as a rectangular recess with a flat planar back wall, a profiled recess with curved top and bottom compartments, and/or an angled recess wherein two sidewalls converge to create a recess without a back wall for receiving joists at positions other than perpendicular to the rim board. The preferred 90-degree receptacle profile provides an I-joist web receiving slot for additional lateral support to help prevent joists from buckling, twisting or rolling over.

17 Claims, 13 Drawing Sheets

CONNECTION AND ATTACHMENT DETAIL
(shown with PROFILED RECEPTACLE RIM BOARD and I-Joist)

MODULAR RIM BOARD FOR FLOOR AND RAFTER SYSTEMS

This application claims priority of prior provisional application Ser. No. 60/360,763, filed Feb. 27, 2002, entitled "Pre-Machined Rim Board for Use with Manufactured I-Joists," the disclosure of which is incorporated herein by this reference.

BACKGROUND OF THE INVENTION

1. Field of Invention

This invention relates to a pre-machined, engineered, perimeter rim board that incorporates joist recessed receptacles that may be manufactured to be universally compatible with all existing and preferably all future I-joists and other manufactured joist products. This invention may be one component in a series of products that comprise installation and structural enhancements for wood frame building construction projects.

2. Related Art

Numerous companies manufacture I-joists, dimensional lumber and other wood products which are used as floor joists and roof rafters in frame building construction. According to I-joist manufacturers, the advantages of I-joists over solid lumber and other wood products include: a) lightweight for ease of handling, b) product uniformity and consistency, c) availability of long lengths, d) high structural integrity, and e) the conservation of old growth forests through use of composite wood fiber materials.

I-joists are comprised of top and bottom flanges made of solid wood, laminated veneer lumber (LVL) and/or oriented strand lumber (OSL), the top and bottom flanges being at the top and bottom edges of a thin center web made of plywood, oriented strand board (OSB) or other structurally approved materials. While these products are well engineered for uniformly distributed top load conditions, the thin web creates unique challenges for solid, stable and secure attachments to conventional rim boards.

Presently, conventional flat-surfaced rim boards, which have rectangular cross section end profiles and which are not machined, are available in the same depths as I-joists. The purpose of these rim boards is to provide stability and additional load capabilities to the ends of I-Joists. Builders have to specifically measure each joist or rafter location before placement and attachment to conventional rim boards.

Most manufactures of I-joists publish details for securing the rim board to joist ends by using a single 8 d box or 10 d box nail into each end of both the top and bottom flanges of the I-joist. This does not favorably compare with the strength of three or four 16 d box nails used to secure rim boards onto the ends of conventional solid framing lumber. Additionally, a minimal attachment of a conventional non-machined rim board to I-joists may not, in many cases, meet today's strict lateral load (wind and seismic) code requirements. Many architects, engineers and designers are faced with specifying special on-site supplemental blocking inside the rim board, which is time consuming and tedious, and which requires additional materials and more labor and creates potential challenges for cutting squarely and to exact proper length.

Practically speaking, many of these on-site structural details, such as the on-site supplemental blocking, are improperly followed or ignored altogether in the field. Therefore, a need exists for a pre-machined rim board product that is easy to install and enhances the structural stability of this important connection while saving time and expense. Further, a need exists for a product that facilitates framing accuracy for all joist and rafter installations while protecting the integrity of I-joists in particular. The present invention meets these needs.

BRIEF SUMMARY OF THE INVENTION

The present invention provides apparatus comprising a rim board, for use in a floor or rafter perimeter, which has at least one, and preferably a plurality of, receptacles for joist/rafter members along the length of the rim board. Preferably, each receptacle is in the form of a recess formed/cut into the body of the rim board in a size and shape adapted for receiving an end of the joist/rafter. Thus, the preferred apparatus is a pre-machined, engineered rim board system with modular recessed receptacles at pre-designated spacing, and methods of using the same. The recesses may be generally rectangular, I-shaped to fit an I-joist, profiled to assist in insertion of the joist/rafter into the recess, and/or other shapes that optimally fit various joists/rafters. An object of the invention is to provide an easy-to-use, cost effective, modular rim board with pre-measured recessed locking receptacles that improves the quality, performance and efficiency of I-joist and other floor and roof framing systems. The rim boards may be provided in different sizes universally conforming to I-joists, dimensional lumber and other manufactured joist products. The invented rim board design, improves the overall performance and installation of I-joist and other floor and roof framing systems.

It is an objective of the present invention to improve the quality, structural stability and speed of installation of joist systems. Other objectives are to enhance the nailing capabilities and to maintain performance and integrity of I-joist products in particular. The invented rim board, when properly installed and secured to joist ends, provides improved lateral loading capacity to floor systems relative to normal end-nailing without additional blocking. The dimensions and shapes of the recessed receptacles help prevent undesirable twisting, buckling or rolling of the joist. The receptacles reduce the shearing forces imparted upon nails used to secure the connection. This factor becomes a critical enhancement for I-joist framing systems with significant lateral loads due to seismic or high wind conditions.

Other functional purposes of the preferred rim board are to; a) allow for increased surface bearing area for the ends of joists on the plate below due to the penetration of the joists into the receptacles, and b) provide for superior nailing patterns for securing joists to the plate due to improved penetration of the I-joist into the receptacle which permits toe nails to be moved away from the edge and toward the center of the plate. Preferred embodiments of the rim board include a receptacle that is profiled and that has a web support slot, which provides vertical stability to the thin web of I-joists under compressive loads.

A further objective of this invention is to make the installation of joist systems more user-friendly. The uniform pre-designated locations of the modular recessed receptacles eliminate the need to measure and mark the placement of each joist at the job site. This saves time, expense and reduces possibilities of installation errors.

DETAILED DESCRIPTION OF THE PREFERRED EMBODIMENTS

Figure 1:
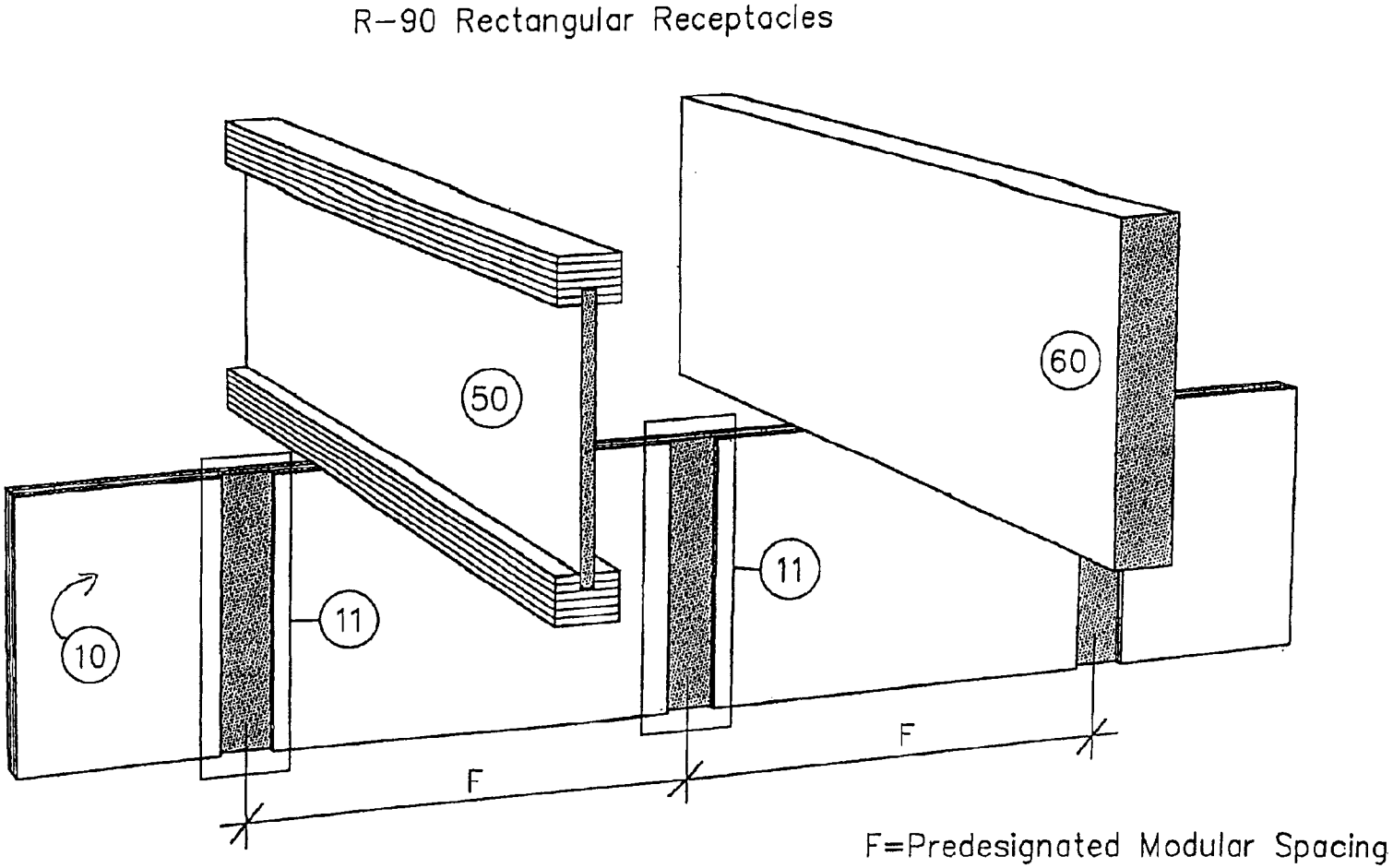
FIG. 1 is an exploded perspective view of one embodiment of the invented rectangular receptacle rim board (R-90), showing how it relates to a typical I-joist or dimensionally rectangular joist framing system.

Referring to the Figures, there are shown several, but not the only, embodiments of the invented RIM BOARD for use with manufactured dimensionally rectangular joists and wood I-joists, and methods of installing the same. The preferred rim board, which is currently called the "Speed-I-Lock™" Rim Board, comprises modular recessed receptacles that are designed and engineered to accept the end profiles of I-joists and other manufactured joists made from solid lumber, reconstituted wood products and other approved materials regardless of dimensional size, shape and/or manufacturer. The preferred receptacle designs feature pre-measured joist spacing to facilitate accuracy and accelerate onsite installation time. The rim boards may be manufactured, for example, from solid softwood and/or hardwood lumber; laminated veneers, reconstituted and composite wood products using various types and/or combinations of adhesive bonding systems; formed by extruding and/or platens compressing wood particles, fibers, strands, chips or flakes; composites such as plastics, acrylics, fiberglass, nylons and/or other synthetic fibers and materials in various forms and/or in combinations that can be used to create strong and durable products that will meet stated and evolving industry performance standards.

The preferred rim board recessed receptacles may be identified according to three general design categories. For joists joining a rim board perpendicular to the rim board the receptacle is either (a) rectangular in shape for acceptance of both dimensional rectangular joists and I-joists of the same flange width, or is (b) specifically profiled for conformance to the unique shape of a particular I-joist. The rectangular and profiled receptacles lock the perpendicular connections of joists into position providing stability and resistance to lateral loads. The third preferred design category of receptacle is for joists joining a rim board at any angle other than 90-degrees, and is a V-shaped design to universally receive one leading edge of the square cut end of dimensional rectangular joists and I-joists.

The preferred rectangular receptacle comprises a single continuous width compartment which accepts the top and bottom flanges of an I-joist or the end cross-section of a dimensional rectangular joist or rafter. The machined sidewalls of the receptacle are straight and perpendicular to the vertical surface plane. The depth of the recessed receptacle provides additional space for penetration for the end of the joist to bear on the plate below.

The preferred profiled receptacle, designed specifically for I-joists, comprises two recessed flange compartments connected by a single vertical web support slot that closely conforms to the unique end profile of an I-joist. The top and bottom recessed flange compartments provide additional lateral support and allow penetration of the end of the I-joists into the rim board for increased surface bearing area on the plate. The vertical web support slot enhances the stability of the web against collapse and failure. The preferred recessed flange compartments are curved toward the center of the rim board. The gentle radius of this curve allows the I-joist to vertically slide downward and lock into position in a rim board that has been already properly positioned on a plate. The gentle radius of the curve helps prevent the I-joist from hanging up on the surfaces of the recess, and particularly from hanging up on a ledge or other abrupt transition from the top compartment to the web slot. The radius of the curve is preferably in the range of about 3–4 inches.

The preferred angled receptacle design for rim boards receiving joists at other than 90-degree angles features continued pre-measured modular joist spacing, but is preferably used with an additional "Support Block," currently called the "Speed-I-Lock™" Support Block, when used with I-joists to enhance structural stability and nailing.

The invented rim board is preferably available for 90, 45, 30, 22.5-degree joist angle connections and in various widths and receptacle profiles to match existing and future joist products. The 90-degree receptacle "lock" for the rectangular receptacle rim board, quick-referenced as the "R-90 Rim Board," conforms dimensionally to the rectangular cross-section of a specific joist, rafter or the flange width of connecting I-joists. The 90-degree receptacle "lock" for a profiled receptacle rim board, quick-referenced as the "P-90 Rim Board," conforms to the unique and specific end profile of a connecting I-joist.

The angled receptacle rim board with 22.5, 30 and 45-degree modular receptacles utilizes V-shaped compartments which lock in one leading edge of the square cut end of a joist. The V-shaped compartment may be continuous and uniform across the entire width of the surface plane of the angled rectangular receptacle rim board, quick-referenced as the "R-22.5," "R-30" and "R-45" rim board, for universal compatibility with all commercially-preferred joists. All angled rectangular receptacles are shaped to universally receive square cut ends of all joists. Also, the V-shaped receptacles can be profiled with separate top and bottom V-shaped compartments on the surface plane of the angled profiled receptacle rim board, quick-referenced as "P-22.5," "P-30" and "P-45" rim board, that conforms to and accepts the flanges of I-joist products only. Eliminating special angled end cutting of joists on-site can save time in measuring, cutting and equipment setup. The preferred methods of connecting an I-joist to an angled receptacle rim board require an additional invented product, the support block, with corresponding cut angled edges to complete the connection of the I-joist to the rim board.

The invented rim boards can be used with a wide variety of diverse and custom designed building plans. The rim board system permits the use of convenient and assorted depths and lengths of rim boards. The system includes optional pre-measured and modular printed "cut lines" between receptacles to assure uniformity in modular space positioning and continuation with the connecting rim boards. The rim boards may be cut and adapted on the job site to fit virtually any custom layout the designer/architect may create. Additionally, approved nailing patterns may be printed along the rim board edges to facilitate proper nailing connections without penetration of nails into receptacles.

Rim board receptacles will be available for but not limited to 8", 16", 19.2" and 24" on-center spacing of joists. These modular spaces will continue an accurate joist configuration even when a rim board angles off at 22.5, 30 or 45-degrees from the initial rim direction.

The preferred methods for attaching a joist to the invented rim board comprise steps that are easily done with little or no measurement and marking of joist locations due to the invented "modular" system that provides receptacles for joists at predetermined locations. The rim board is installed from a pre-selected starting point at one corner of the building and is minimally fastened to the perimeter of a plate in preparation to accept the joists. Joists are then cut to appropriate length, visually aligned and lowered or inserted into the recessed receptacle of the rim board.

When the rectangular receptacle rim board is chosen, installation of the joist in the rim board is done in a simple and efficient manner, with the joist end being slid directly into the receptacle, from either a position above the rim board or in front of the rim board. When installed in the recessed receptacle, the end of a joist is "locked" in the rim board with lateral movement restrained by the side walls of the recessed receptacle. Final steps will include further securing of the rim board and the joists to the plate. I-joists should be always secured to the plate and to the rim board according to the preferred nailing schedule specified by the I-joist manufacturer.

When the preferred profiled receptacle rim board is chosen, installation of the joist in the rim board may still be done in a simple and efficient manner, wherein as the I-joist bottom flange is lowered into the 90-degree profiled receptacle rim board (P-90 Rim Board), it travels along its guided path down through the top flange compartment, slides over the preferred gently-curved surfaces of the profiled receptacle, and proceeds downward over the vertical web support slot before dropping and "locking" into place with the joist top flange in the top flange compartment and the joist bottom flange in the bottom flange compartment. Thus, the preferred curved "slide and lock" feature of the P-90 receptacle allows for a generally trouble-free and smooth installation that may not be experienced if all side walls, corners and edges were machined vertical and square, as in the optional and alternative method for machining the recessed receptacle that results, for example, in a rectangular receptacle rim board.

Now referring specifically to the Figures by number:

FIGS. 1 through 13 represent views of the preferred embodiments of the invented rim board. The rim board designs will be used preferably by framers when constructing floor and roof systems with I-joists and/or other manufactured wood joist products. The invented rim board 10, 20, 30 and 40 offers structural and nailing enhancements relative to the present industry standard. Additionally, the products save installation time and improve the layout accuracy in the field.

FIG. 1 shows how a typical I-joist 50 and rectangular dimensional joist 60 relate to the invented rectangular receptacle rim board (R-90) 10 when attaching perpendicularly to the rim board. The recessed receptacle 11 maintains preferred uniform modular spacing of 8", 16", 19.2" or 24" on center.

Figure 2:
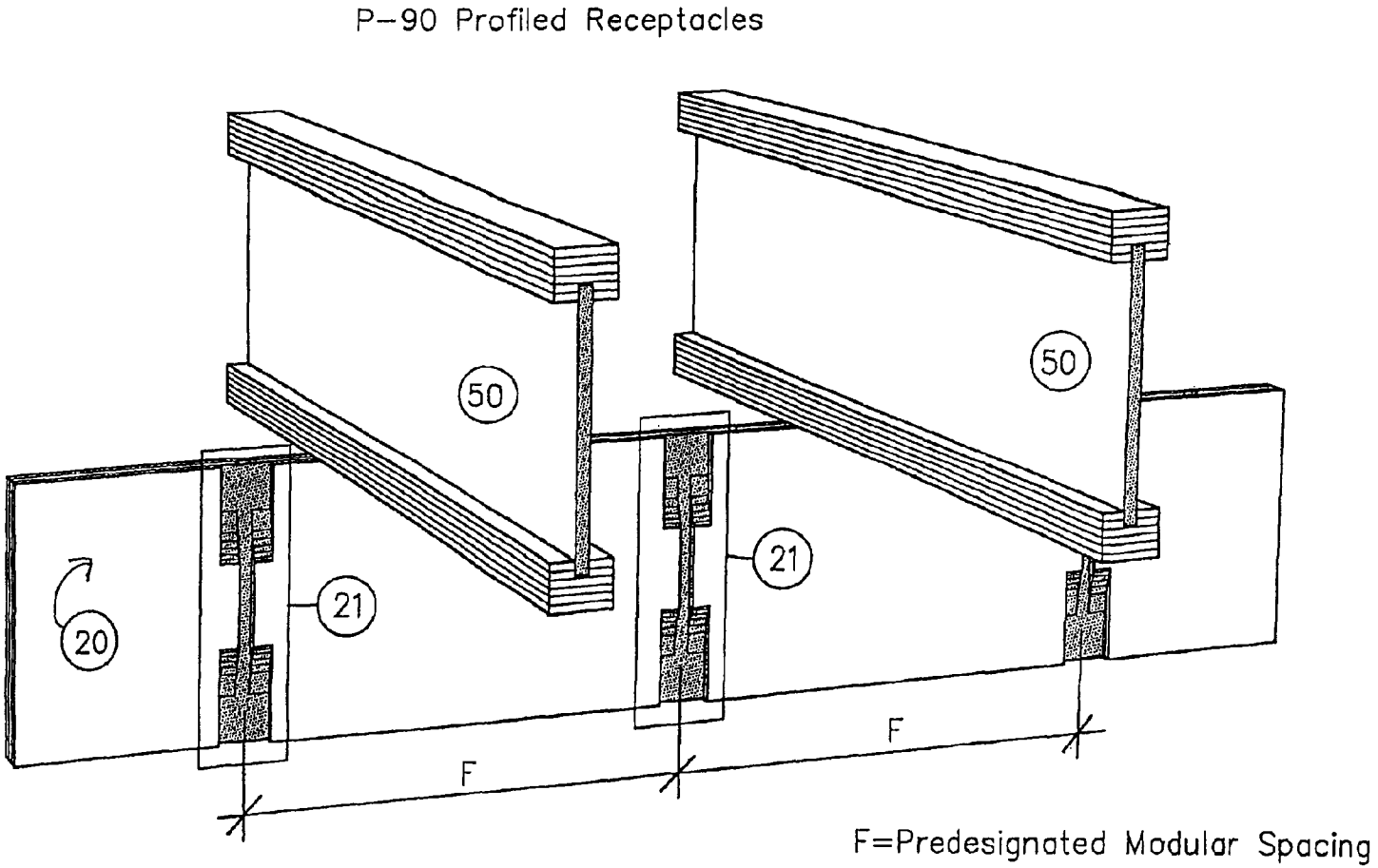
FIG. 2 is an exploded perspective view of one embodiment of the invented profiled receptacle rim board (P-90), showing how it relates to a typical I-joist framing system.

FIG. 2 demonstrates how a typical I-joist 50 relates to the invented profiled receptacle rim board (P-90) 20 when attaching perpendicular to the rim board. The preferred profiled receptacle is "profiled" in that it has an I-shape outline, which is preferred but not absolutely necessary for the I-joist. (See FIG. 1, wherein a rectangular receptacle is used for both a rectangular joist and an I-joist). The recessed profiled receptacle 21 maintains preferred uniform modular spacing of 8", 16", 19.2" or 24" on center.

Figure 3:
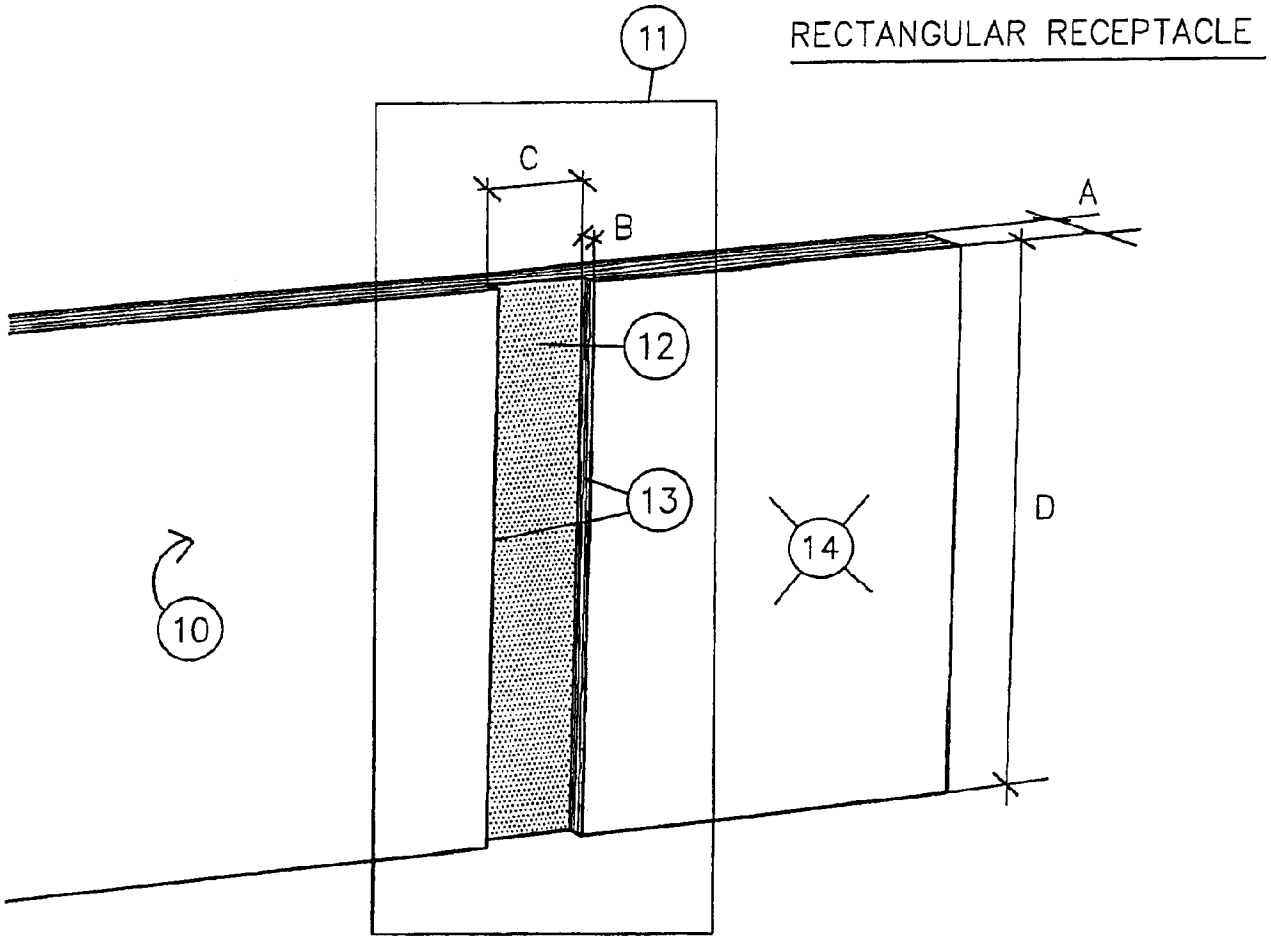
FIG. 3 is a detail perspective side view of the rectangular receptacle (R-90) of FIG. 1 for I-joists or dimensionally rectangular joists used with floor or roof systems that are connected at 90-degree angles to the rim board.

FIG. 3 demonstrates the preferred basic form and dimensions of the rectangular recessed receptacle (R-90) 11 for standard 90-degree rectangular receptacle rim boards 10. The receptacles are machined to conform generally to the various widths of rectangular shaped joist and/or the flange widths of I-joists. Each receptacle is a recessed rectangular compartment with a back wall 12 and two vertical side walls 13 which are perpendicular to the surface plane 14 of the rim board. Once installed into the rim board, the joists are "locked" into place by virtue of lateral movement being restrained by the sidewalls 13.

FIG. 3 Note: A=Varies (1⅛" to 1¼" preferred)

B=Varies (¼" to ⅜" preferred)

C=Joist width (or flange width)+1/16" (preferred)

D=Joist depth

Figure 4:
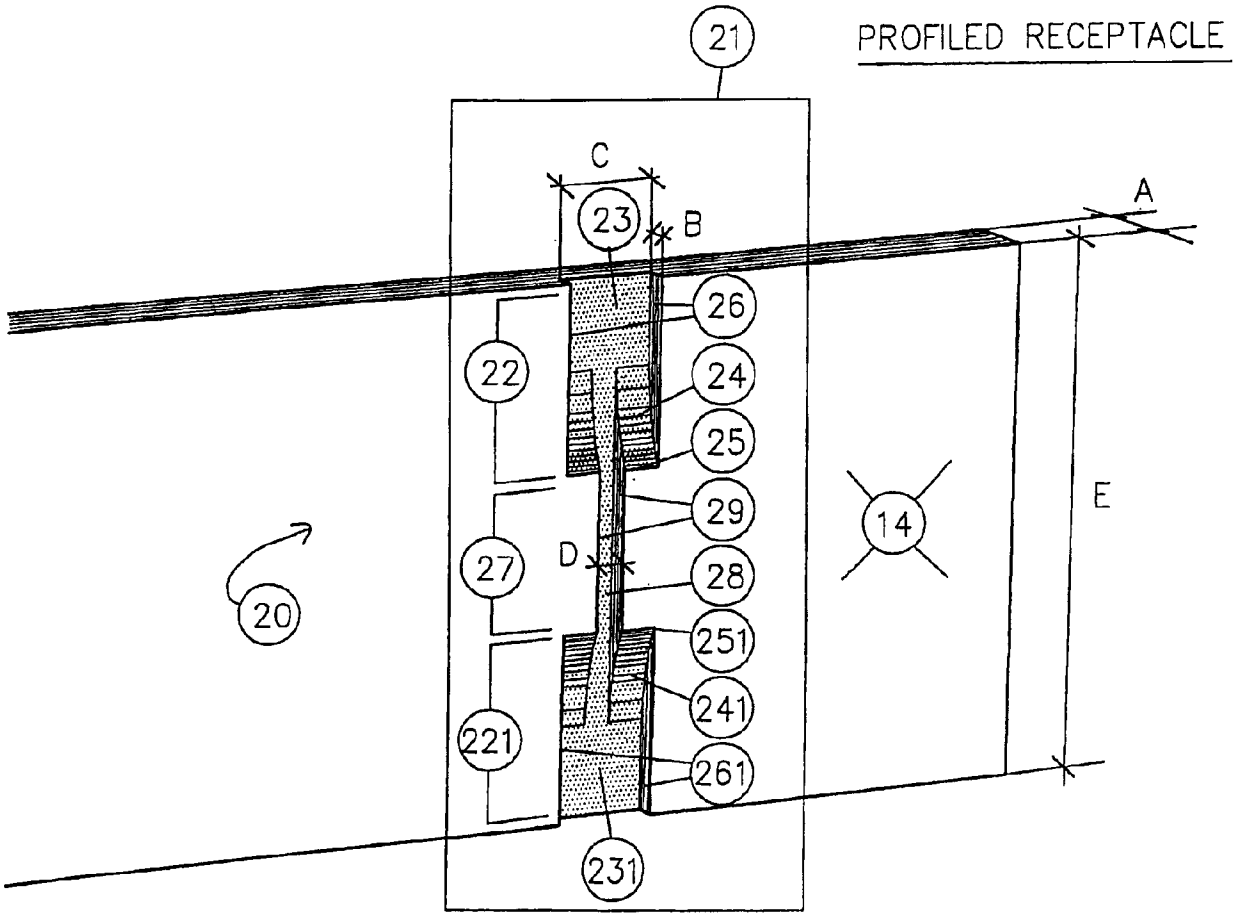
FIG. 4 is a detail perspective side view of the profiled receptacle (P-90) of FIG. 2 for I-joists connecting at 90-degree angles to the rim board.

FIG. 4 demonstrates the preferred basic form and dimensions of the profiled recessed receptacle (P-90) 21 for a standard 90-degree profiled receptacle rim board 20. The receptacles are machined to conform generally to the various profiles of I-joists. Each receptacle comprises top 22 and bottom 221 recessed flange compartments near the top edge and the bottom edge of the rim board, respectively. The top recessed flange compartment 22 opens from the top and features a back wall that comprises a flat back wall 23 at the upper end of the top recessed flange compartment, and curved riser portion 24 that curves from the flat back wall surface 23 toward the surface plane 14 of the rim board completing the top compartment at the transition point 25 towards the center of the rim board. In other words, the riser portion 24 curves toward the viewer in FIG. 4, "forward" toward the front surface of the rim board 20. The back wall surface 23 and the riser portion 24, therefore, may be said to form a generally concave top compartment wall, preferably wherein there is no lip or other obstacle at the top edge of the compartment to hinder movement of the joist into the top compartment from above. The top recessed flange compartment 22 also has side walls 26 that extend perpendicularly from the back wall 23.

The bottom recessed flange compartment 221 has similar, and preferably the same, forms 231, 241, 251 and 261 as the top recessed flange compartment except that they are reversed in position to open up to the bottom edge of the rim board. The flange compartments are sized and machined to accommodate various sizes of I-joist flanges.

The top and bottom flange compartments are preferably shaped and sized the same so that orientation of the rim board is not crucial and in fact the rim board may be reversed edge-to-edge without the I-joist hanging-up on non-curved surfaces during the step of lowering the I-joist into the receptacle or during the less-frequent step of raising the I-joist up out of the receptacle. However, as less-preferred options, only one of the compartments or none of the compartments may have curved back wall surfaces. For example, a rim board may have top flange compartment with a curved lower back wall surface and a bottom flange compartment with a non-curved back wall surface. Such a less-preferred option would result in the rim board having one preferred orientation with the curved top flange compartment at the top, because reversing such a rim board edge-to-edge would tend to allow I-joist hang-up on the ledge of the non-curved flange compartment during installation of the I-joist into the rim board.

A vertical web support slot 27 extends vertically between the top 22 and bottom 221 recessed flange compartments with a single flat back wall 28 and two vertical side walls 29 that extend perpendicularly from the back wall 28. The combination of the top and bottom recessed flange compartments and the vertical web support slot create a recessed receptacle that runs from the rim board top edge to bottom edge that is symmetrical around a center point, so that the rim board could be flipped edge-to-edge and still present the same recessed receptacle shape to the I-joist.

As depicted in the drawings, the general shape of the profiled recessed receptacle (P-90) 21 and preferred gentle machined curves 24 and 241 allow I-joists to "slide and lock" in place when being installed from the top down into a rim board that has already been positioned on a plate. The end of an I-joist may be lowered into its top flange compartment 22, wherein the I-joist flange may progress down along the flat back wall 23, continuing to slide over the gentle curved extended back wall 24 of the top compartment 22 without catching or becoming wedged against the rim board in an inappropriate position. As the I-joist continues its guided path in the profiled recessed receptacle 21, relative to the rim board, the bottom flange of the I-joist slides out from the top compartment 22 at the transition point of the compartment 25 and over the area of the vertical web support slot 27 and enters the bottom compartment 221 in reverse order of sequence, that is, by sliding along or near the curve 241 and toward back wall surface 231. Finally, as the joist bottom flange slides into the bottom compartment, the I-joist top flange slides into the top compartment 22 and the I-joist web slides into the vertical web support slot 27.

During this installation, the rim board may flex slightly to accommodate the I-joist's movement and the end of the I-joist becomes "locked" into the recessed receptacle. This "locking" occurs by means of the top and bottom flanges "locking" into recessed flange compartments 22 and 221, wherein the top and bottom surfaces of the I-joist are flush with the top and bottom surfaces of the rim board, and the I-joist flanges are laterally supported by the side walls 26 and 261, thus preventing lateral movement of the flanges relative to the rim board. Also, the I-joist web "locks" into the vertical web support slot 27 due to the web being laterally supported by the side walls 29, thus preventing lateral movement of the web relative to the side walls 29. Once the rim board is properly positioned on the plate, the I-joist is permanently nailed into place in the rim board and both are secured to the plate according to an approved nailing schedule.

FIG. 4 Note:

A=Varies (1⅛" to 1¼" preferred)

B=Varies (¼" to ⅜" preferred)

C=I-joist flange width+1/16" (preferred)

D=I-joist web width+1/16" (preferred)

E=I-joist depth

Figure 5:
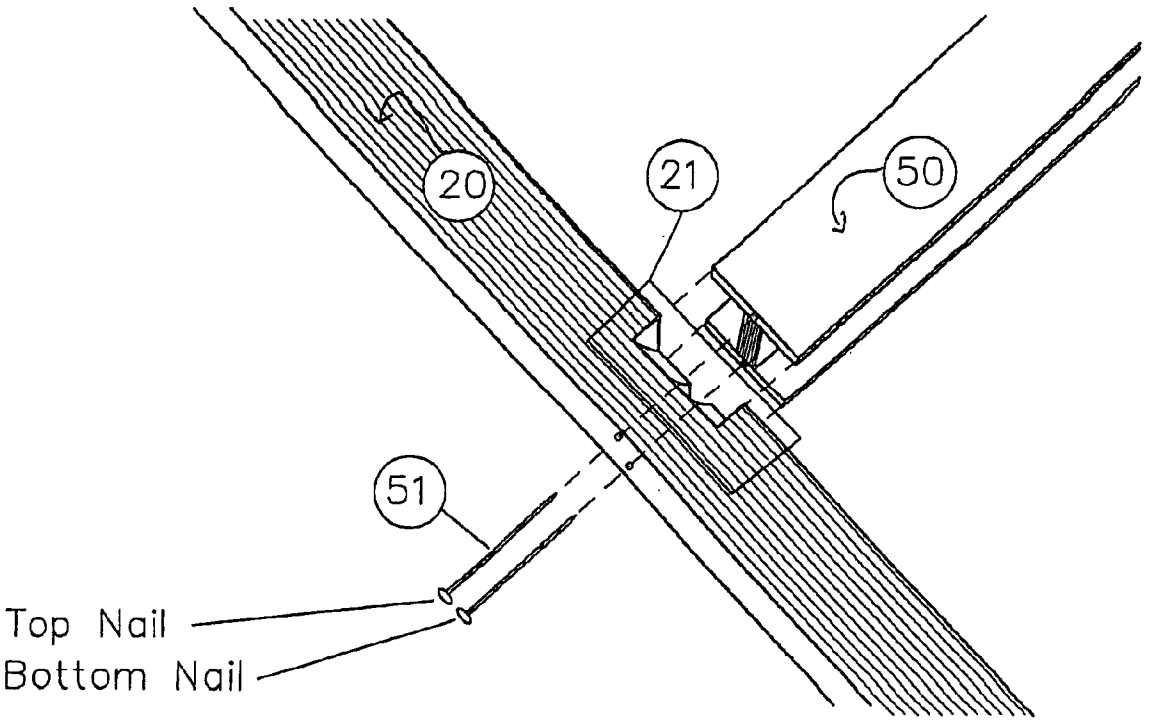
FIG. 5 is a perspective top view showing one embodiment of a method of attaching an I-joist to a profiled receptacle rim board (P-90).

FIG. 5 illustrates how a typical I-joist 50 is locked into the profiled recessed receptacle 21 of the invented rim board. The standard connection of an I-joist 50 to the invented profiled receptacle rim board (P-90) 20 utilizes flange end nailing 51 as specified by the I-joist manufacturer.

FIG. 5 Note: Most I-joist manufacturers allow only one 8 d or 10 d box nail into each of the top and bottom flanges of the I-joists.

Figure 6:
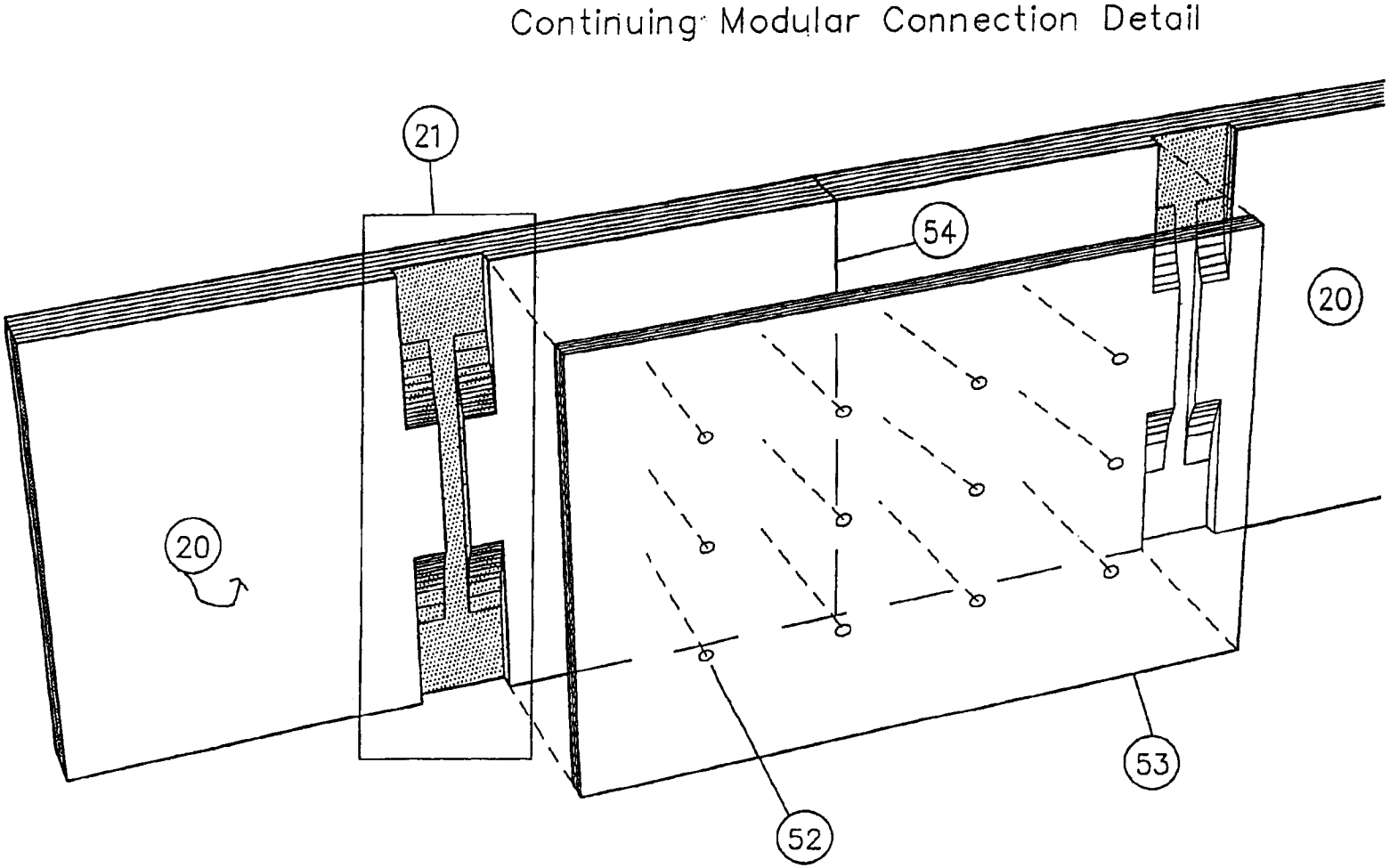
FIG. 6 is a perspective side view of one method of connecting the end of one rim board to another using a gusset between the modular recessed receptacles, using a P-90 rim board embodiment.

FIG. 6 shows how two profiled receptacle rim boards (P-90) 20 can be connected 54 to another using a gusset made from plywood, OSB, other approved materials or connectors 53 between the recessed receptacles 21 and secured with approved box nails 52, staples or other devises. Structural engineers and designers may also specify metal tie straps, plates or other approved hardware or devises to meet requirements for this connection. Connections 54 may be made along optional "cut lines" printed on the invented rim boards that are exactly midway between the recessed receptacles 21, as shown in FIG. 6.

Figure 7:
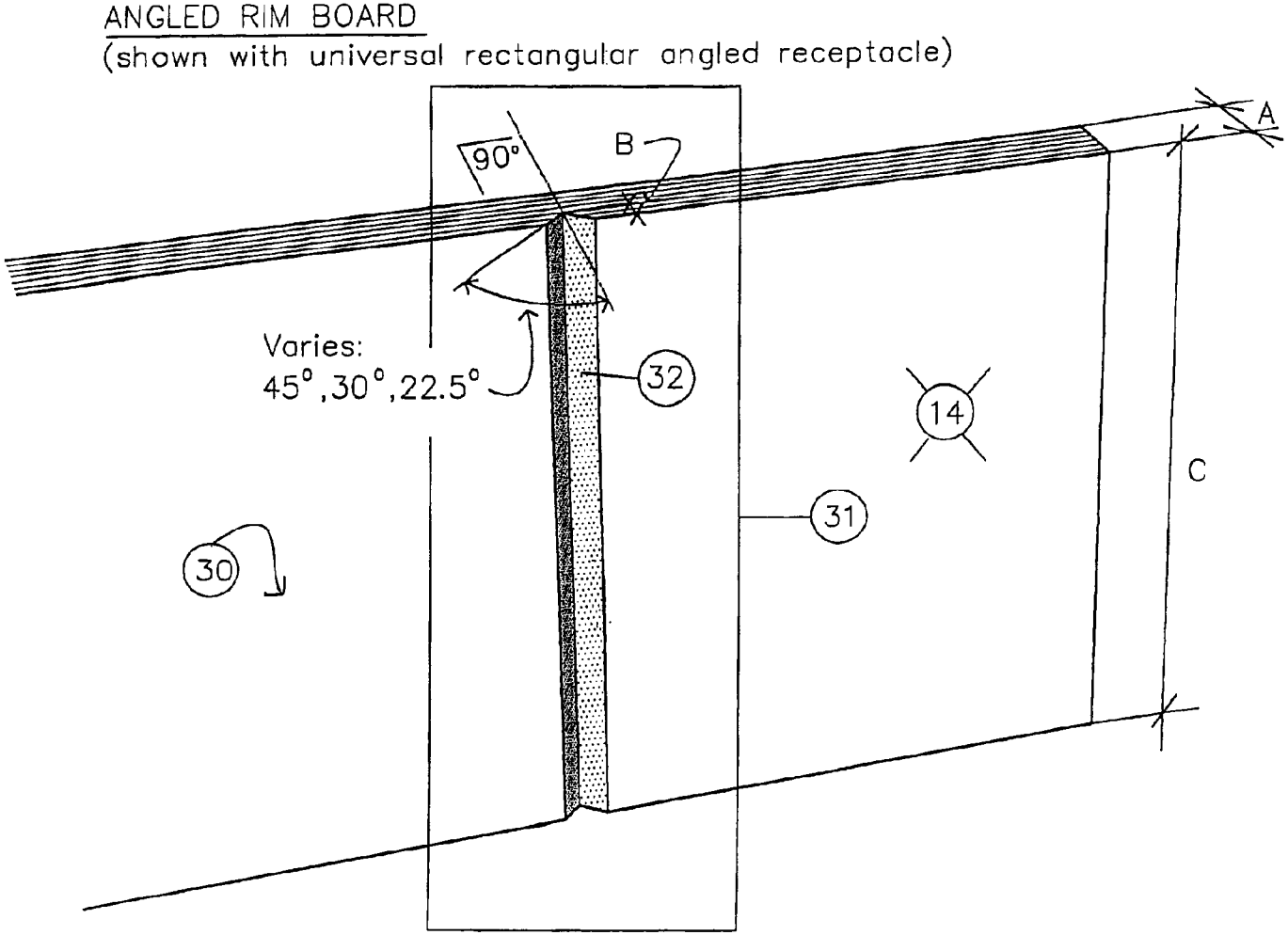
FIG. 7 is a detail perspective side view of the one embodiment of the "universal" continuous V-groove of the invented angled rectangular receptacle) rim board (R-22.5, R-30 and R-45) for dimensionally rectangular joists or I-joists connecting at angles other than 90-degrees.

FIG. 7 demonstrates the basic form and dimension of the angled receptacle rim board 30 with the "universal" angled rectangular receptacle 31. The receptacle is machined as an angled V-grooved compartment 32 transversely across the entire surface 14 of the rim board. This compartment 32 receives either the square cut leading edge of a rectangular shaped joist or the square cut leading edges of the top and bottom flanges of an I-joist. With this embodiment, the ends of both the rectangular-shaped joist and the I-joist can be square cut so that one leading edge of the joist "locks" into the invented Rim board.

FIG. 7 Note: A=Varies (1⅛" to 1¼" preferred)

B=⅜" (preferred)

C=Joist depth

Figure 8:
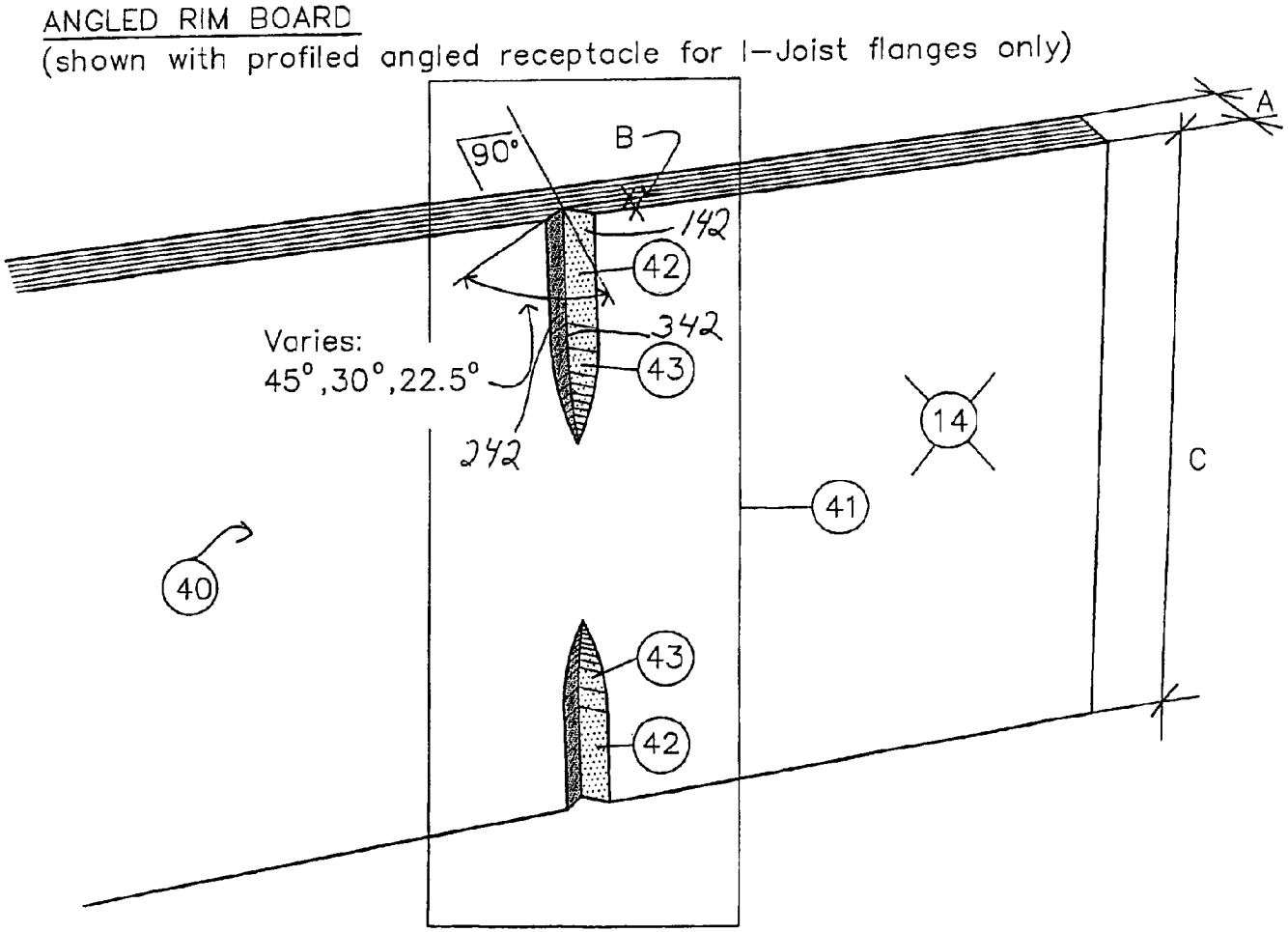
FIG. 8 is a detail perspective side view of one embodiment of the invented profiled angled receptacle rim board for I-joist connecting at angles other than 90-degrees.

FIG. 8 demonstrates the preferred basic form and dimensions of the angled receptacle rim board 40 with the angled profiled receptacle 41. This receptacle is for I-joists only and comprises top and bottom machined angled V-grooved flange compartments 42 for the top and bottom flanges of I-joists. The two sidewalls 142, 242 of these compartments meet at the rearmost extreme 342 of the compartment. With this embodiment, the end of the connecting I-joist can be square cut so that the one leading edge of the flanges "locks" into the compartments. Gentle machined curved surfaces 43 are present where the angled V-grooved flange compartments curve (forward toward the view in FIG. 8) towards the surface plane 14 of the center of the rim board.

FIG. 8 Note: A=Varies (1⅛" to 1¼" preferred)

B=⅜" (preferred)

C=Joist depth

Figure 9:
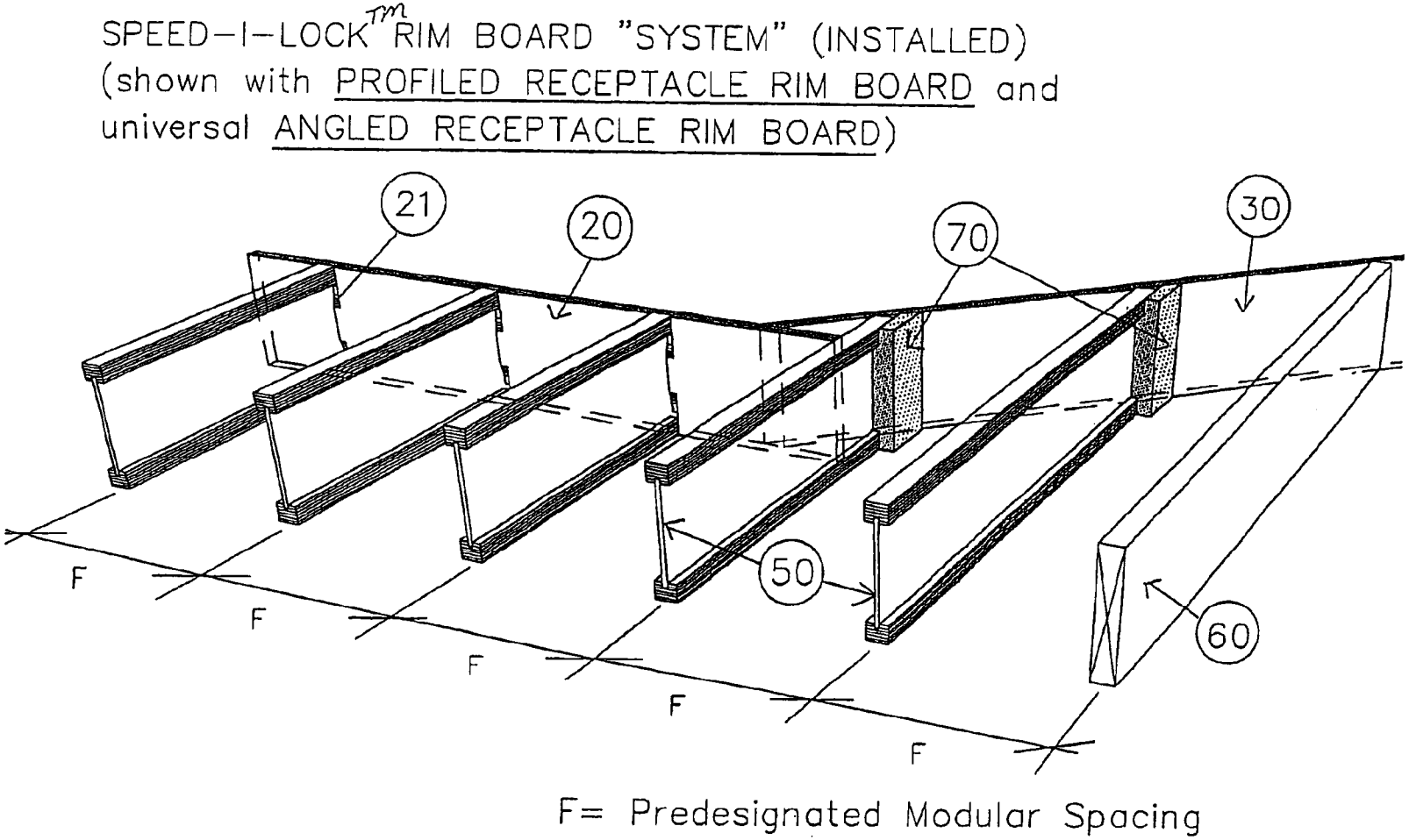
FIG. 9 is a perspective side view of the one embodiment of the invented 90-degree profiled receptacle rim board (P-90) and the invented angled profiled receptacle rim board (P-22.5, P-30 and P-45), showing how they relate to continuing the modular spacing of joists, and showing angled support blocks according to one embodiment of the invention completing the connection of the I-joists to the angled receptacle rim boards.

FIG. 9 illustrates how a typical invented 90-degree profiled receptacle rim board (P-90) 20 merges with a "universal" angled rim board (R-45) 30 and the modular spacing of joists are maintained through the transition from 90-degrees to a selected angled connection. When I-joists are attached to an angled rim board the use of another product, called Speed-I-Lock™ angled support block 70, is required to complete the connection.

FIG. 9 Note: angled support blocks 70 are not used with dimensionally rectangular joist products.

Figure 10:
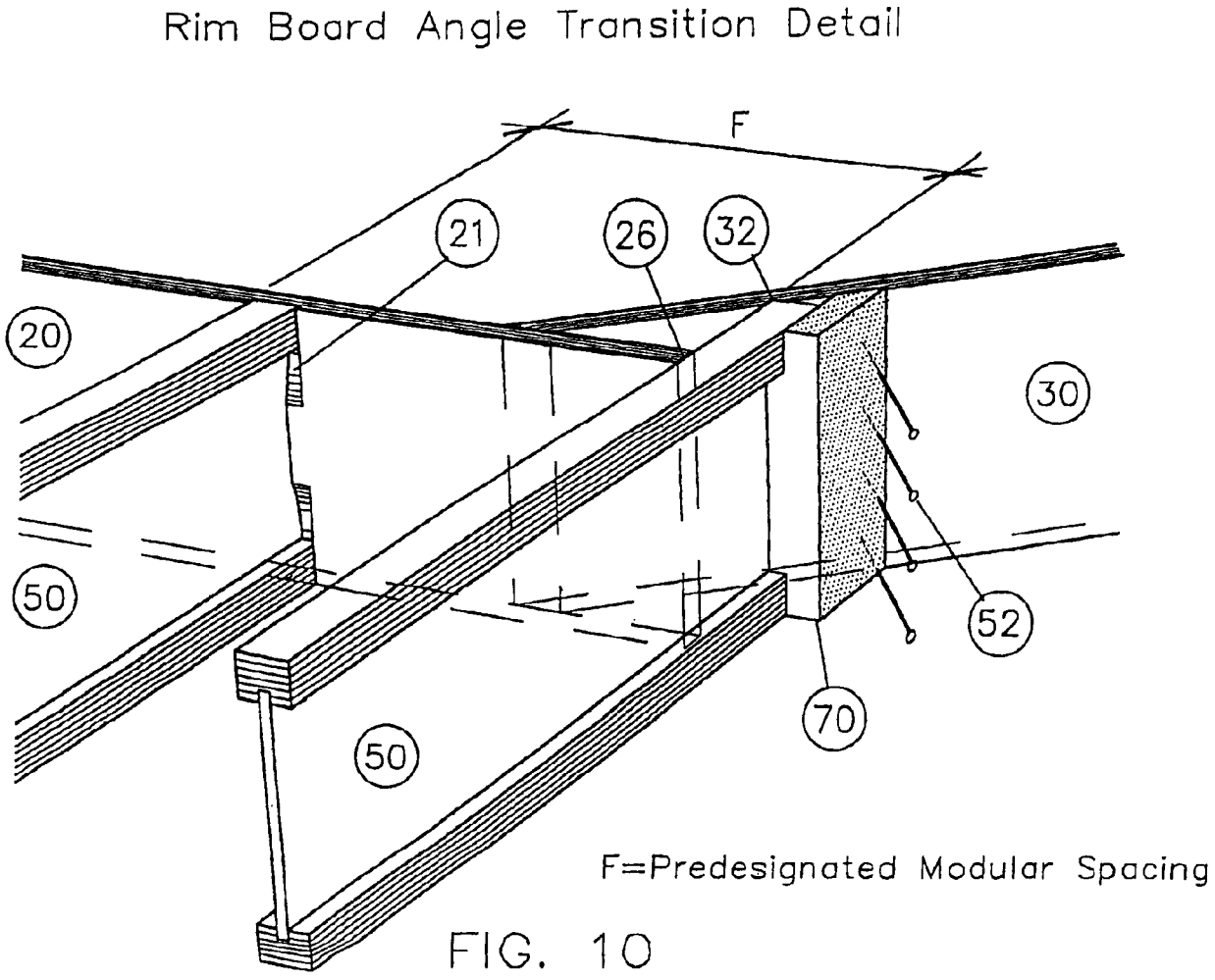
FIG. 10 is a detail perspective view of how an I-joist may attach to the invented rim boards, according to one embodiment of the invention, on either side of the transition point from a 90-degree rim board (P-90) connecting to an angled rectangular receptacle rim board (R-45).

FIG. 10 details how the modular spacing of the I-joist 50 is maintained during the transition from the standard 90-degree rim board 20 to the angled rim board 30. By cutting the rim board 20 vertically in-line along the left side of 26 of the subsequent recessed receptacle 21, the first I-joist into the angled rim board 30 automatically positions the following I-joists for continued correct spacing. The V-shaped recessed flange compartment 32 of the angled rim board may be then aligned to the corner of the extended I-joist to assure proper spacing of additional I-joists into the angled rim board. The angled support block 70 with appropriate nails 52 completes the connection.

Figure 11:
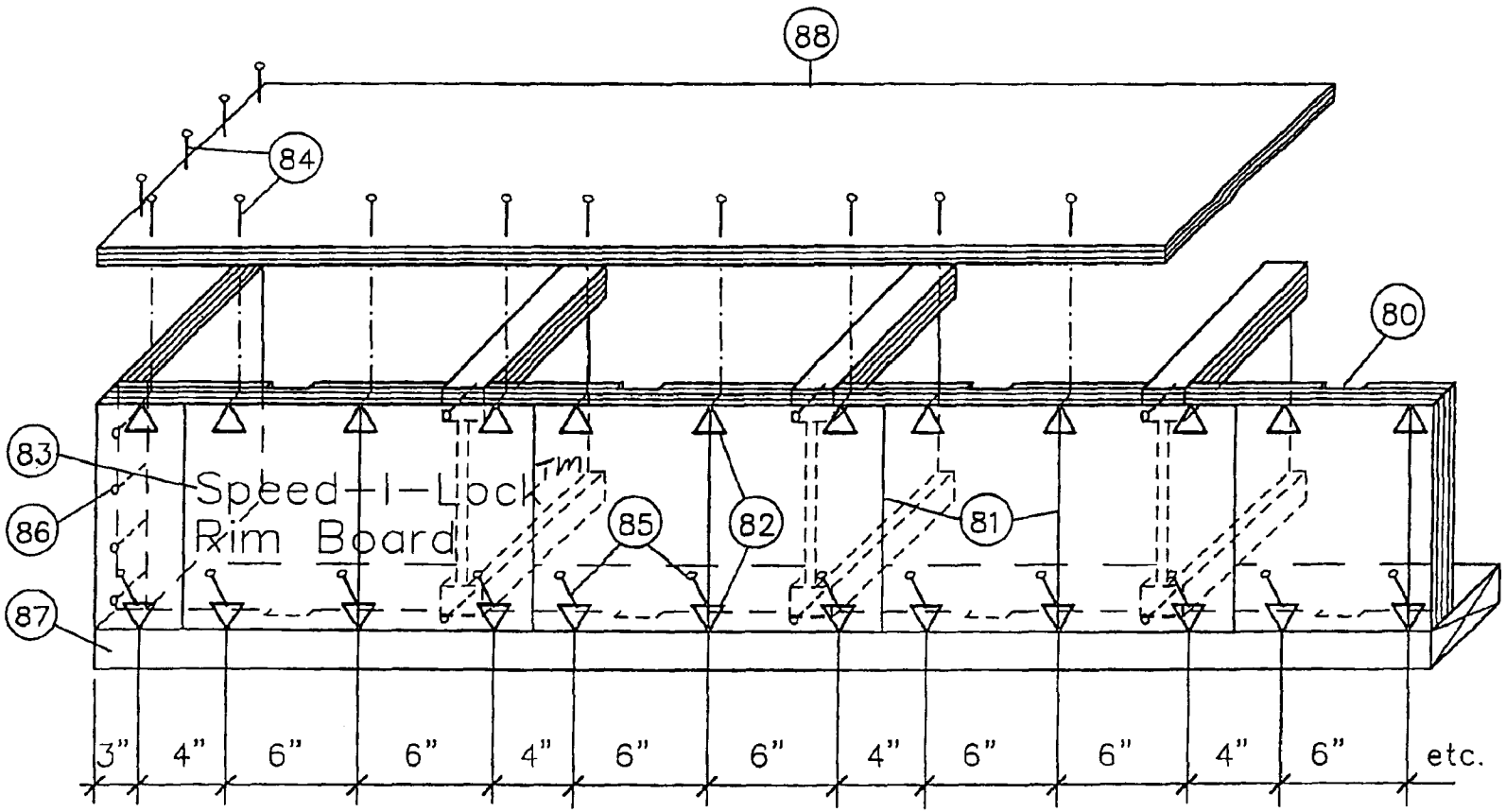
FIG. 11 is a detail perspective view of the exterior surface of the rim board, according to one embodiment of the invention, showing the preferred attributes of printed modular "cut lines" and an approved printed nailing pattern for edge nailing of sub-floor to rim board and rim board to plate.

FIG. 11 illustrates the detailed attachment of a 90-degree rim board, with receptacles 8" on center, and how it relates to the I-joists, sub-floor and plate. Included in the illustration are the preferred printed "cut lines" 81 and the preferred and approved printed nailing locations and patterns 82. The preferred "cut lines" 81, midway between the receptacles, provide easy to use modular pre-measured cutting guides to assure proper splicing and accurate repetitive continuation of the receptacles and I-joist spacing. The nail placement indicator marks 82 provide exact locations for recommended, approved and preferred nailing patterns. The actual logo 83 of the manufacturer can be included in the printing process at the same time as the "cut lines" and nail mark indicators. The nailing pattern along the perimeter of the sub-floor sheathing 84 should be closely aligned with the nail placement mark indicators 82 printed on the rim board to avoid nailing into the receptacles. Also, the installer should place or align the nails for securing the rim board to the plate 85 as close as possible to the nail placement indicator marks to adhere to approved nailing schedules and patterns. The rim board is appropriately toe-nailed to the approved plate 87 with the identical nailing pattern 82 as depicted with the sub-floor sheathing. The end nailing of rim boards at corners 86 should comply with manufacturer recommendations. The sheathing or sub-floor 88 should be installed to conform to approved attachment specifications by the manufacturer and building code.

Figure 12:
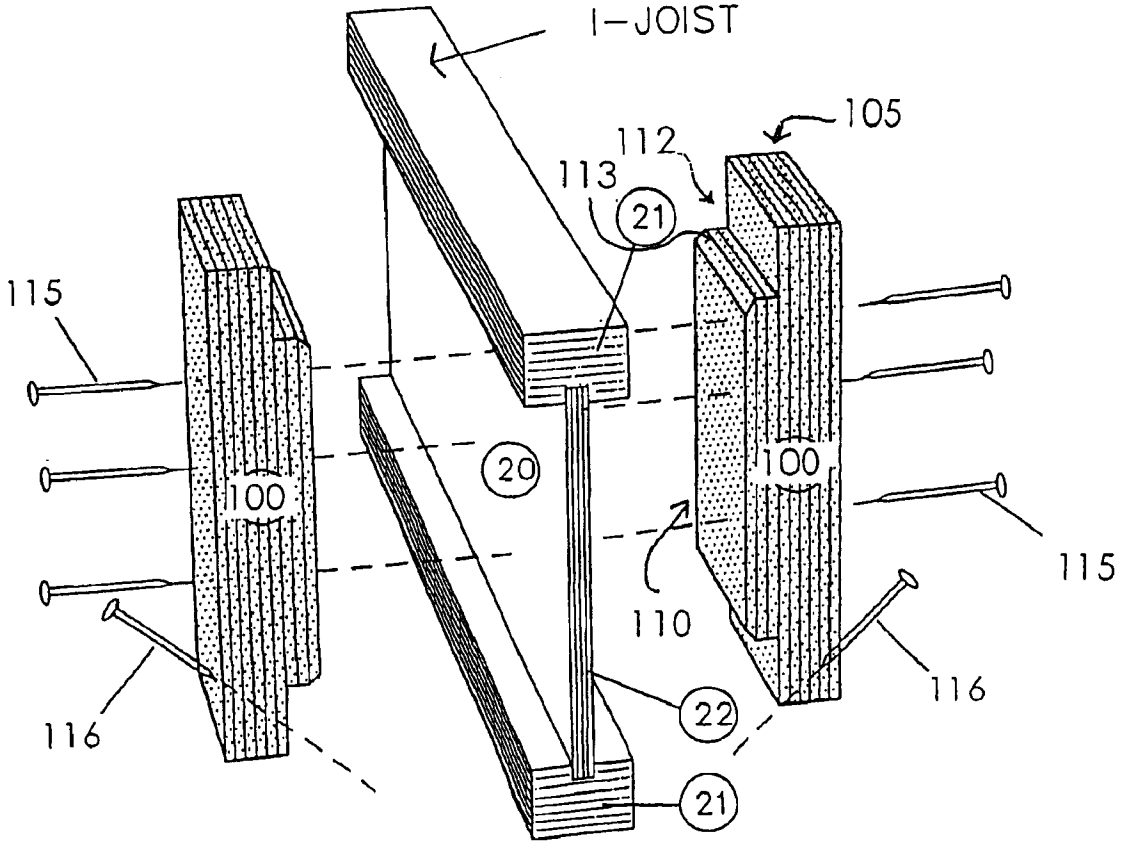
FIG. 12 is an exploded perspective view of one embodiment of two invented support blocks that may be used according to one embodiment of the invention in combination with an I-joist.
Figure 13:
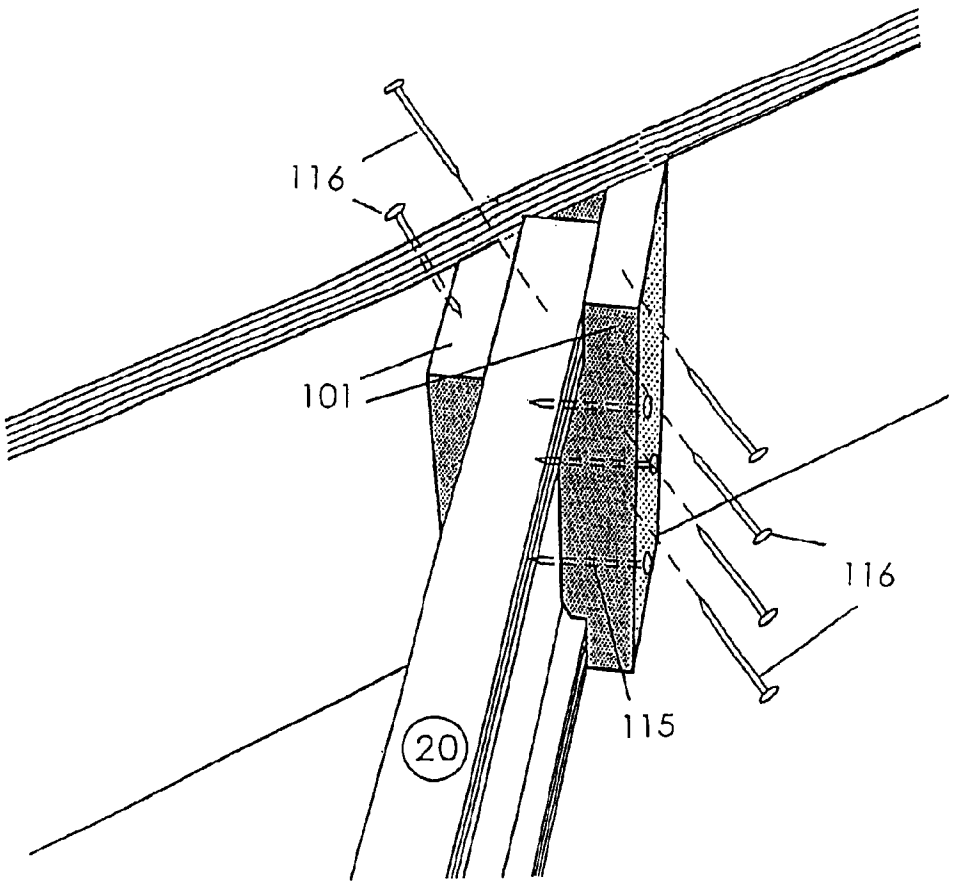
FIG. 13 is a detail view of an I-joist and two invented support blocks in use with an embodiment of the rim board.

FIGS. 12 and 13 illustrate embodiments of optional support blocks 100, 101 that may be used with the rim board of the invention. The preferred support blocks 100, 101 are prefabricated, pre-cut, shaped, milled and profiled structural blocks that preferably may be made to be universally compatible with all existing and preferably all future I-joist manufactured products. The preferred design of the invented support block may conform to the side profile of an I-joist, providing added support, reinforcement, nailing surface, bearing area, and protection of the integrity of the connection of the I-joist to the rim board. It may be used at load-bearing points where additional support is required, and/or at joist ends where an increased end-surface area is needed to: a) comply with code specified nailing schedules for attaching I-joists to plates; or b) secure rim boards and trim components to I-joists.

The preferred support block provides additional compressive point load capacity, increases lateral stability to an I-joist web, provides improved nailing capabilities, and assists in maintaining the integrity of the I-joist flanges. Additionally, it is easy to use, saves time and installation costs in the field. This product when properly nailed or stapled in place to the joist web and not to the flange provides significant improvements to a building system using I-joists. An application option is the additional use of an approved sub-floor adhesive on the contact surfaces between the support block and the I-joist, which further compliments overall performance of the installation.

The support block may be made available for, but not limited to: 9½", 11⅞", 14", and 16" deep "I-joists", with 1½", 1¾", 2", or 2 9/16" wide top and bottom flanges. The support block may be produced in varied sizes and out of various material types to create different performance standards and to meet specific industry and market needs. Support blocks may be manufactured in various widths to accommodate different bearing wall/plate widths. Additionally, angled end cuts of 45, 30, and 22.5 degrees are preferably utilized to conform the support block to various angles of connecting rim boards.

The support block comprises a "Load-Jack" portion 105 which is squarely cut to preferably be exactly the same depth as the I-joist or not more than 1/16 inch greater depth than the I-joist depth, wherein "depth" means the dimension from the top surface of the top flange to the bottom surface of the bottom flange of the I-joist. The support block should not be cut to less depth than the I-joist depth, as this would result in the installed support block not possessing any load-bearing capacity. The load-jack portion bears the majority of the compressive load. Also, it can receive additional nails which may be required for a joist connection, thereby reducing risk from improper and/or excessive nailing into the joist flanges. A properly installed support block becomes an integral part of an I-joist so that it can be nailed directly through to the plate to help meet nailing requirements of securing the joist to the plate. For load-jacks comprised of solid wood or composite wood products, a vertical grain orientation, that is, parallel to the depth dimension of the I joist, may be specified for increased compressive load capacity.

Also, a support block comprises a "web and flange support" portion 110 that is attached to and reinforces the thin web of an I-joist, helping to prevent buckling, rolling, or twisting of the I-joist under peak load conditions. This web and flange support portion is preferably about 1/16" shorter than the inside distance between the flanges to prevent inappropriate forces to be placed on the flanges, and hence to protect the integrity of I-joist glue joints between the flanges and the web. The web and flange support portion preferably has machined outside edges 113 to allow room for an appropriate fit in the presence of irregular glue beading that may occur in the I-joist manufacturing process between the I-joist flange and the I-joist web. The vertical dimension of the web and flange support is less than the load-jack, thus creating flange notches 112 along the top and bottom edges. The entire support block may be machined or milled from a single solid block or from two or more components laminated together. Methods of installing the support blocks 100, 101 by using nails 115, 116 are shown in FIGS. 12 and 13. Although FIG. 13 illustrates two angled support blocks in use with an angled recessed receptacle according to one embodiment of the invention, other embodiments may include use of support Blocks with I-joists installed in 90 degree rectangular and/or profiled receptacles.

In the preferred embodiments, the rim board is provided from the manufacturer with the pre-machined or otherwise-formed recessed receptacles extending into the body of the rim board, preferably without any bracket or other hardware on the rim board to hold joists. Thus, it may be seen that the invented rim board may consist of a rim board length having a plurality of spaced recesses, wherein each recess is preferably adapted to hold one joist generally perpendicularly (or, optionally, within a range of about 20–90 degrees relative to the front surface of the rim board). Preferably, therefore, the rim board as supplied by the manufacturer does not include any hardware or other structure extending out from the front surface of the rim board or extending over the top or bottom edge of the rim board.

The recesses should not extend more than a prescribed amount into the rim board, so as not to detract from the overall performance of the rim board. An example of acceptable recess depth include ¼–⅜ inch deep recesses (at their rearmost extremes, for example, dimension B in FIG. 4) in a rim board 1⅛–1¼ inches thick (dimension A in FIG. 4). The inventors expect that recesses with depths up to about ⅓ of the thickness of the rim board may be desirable, but the recess depth may be governed by local building codes and specifications regarding minimum rim board thickness.

The term "pre-manufactured" means that the recessed receptacles and other fabrication of the rim board are done prior to delivery to the job site, rather than at a construction site.

The term "modular" refers to the features of pre-determined spacing and pre-machined recessed receptacles that are fabricated before delivery to the construction site. This allows the product to be delivered and installed without adapting the rim board to any significant extent except perhaps cutting the rim board to length, connecting rim boards end-to-end, and nailing rim board to plate, providing optional support blocks against I-joists, and nailing sub-floor to the rim boards. With the preferred system, the joist/rafter member is supported by the plate and held laterally by the sidewalls of the recessed receptacles so that lateral movement of the joist/rafter member is restricted.

Although this invention has been described above with reference to particular means, materials and embodiments, it is to be understood that the invention is not limited to these disclosed particulars, but extends instead to all equivalents within the scope of the following claims.

What is claimed is:

1. A rim board for flooring or rafter installations for use with joists, the rim board having a front surface, first end, a second end, and a length between the first end and second end, a top edge, a bottom edge, and a transverse depth between said top edge and bottom edge, the rim board further comprising a plurality of recesses in said front surface for receiving ends of said joists; and wherein said rim board is adapted for use with an I-joist having a top flange, a bottom flange, and a web, wherein at least one of said recesses comprises a top compartment with a width for receiving the top flange, a bottom compartment with a width for receiving the bottom flange, and a central slot extending between the top compartment and bottom compartment and having a width that is less than the widths of the top and bottom compartments for receiving said web.

2. The rim board as in claim 1, wherein said top compartment has a curved back wall.

3. The rim board as in claim 1, wherein said bottom compartment has a curved back wall.

4. The rim board as in claim 1, wherein said top compartment has a curved back wall and said bottom compartment has a curved back wall.

5. The rim board as in claim 4, wherein said top compartment curved back wall curves outward toward the rim board front surface near said central slot.

6. The rim board as in claim 4, wherein said bottom compartment curved back wall curves outward toward the rim board front surface near said central slot.

7. A rim board system for flooring joists and roof rafters, the system comprising:

an elongated rim board for forming a perimeter of a floor or a rafter installation, the rim boards having a front surface and a recess extending into the rim board from the front surface; and a joist or rafter member having an end and two lateral side surfaces, the joist or rafter member received in the recess so that the joist or rafter member is secured from lateral movement relative to the rim board; and wherein said joist or rafter member is an I-joist with a top flange, and bottom flange, and a web, and wherein said recess is a profiled recess, the profiled recess comprising a top compartment for receiving the top flange and a bottom compartment for receiving the bottom flange, and a slot extending between the top and bottom compartments for receiving the web.

8. The rim board system as in claim 7, comprising a fastening system adapted to fasten said joist or rafter member in said recess, the fastening system consisting only of nails.

9. The rim board system as in claim 7, wherein said recess is a profiled recess having at least one curved rear wall and two sidewalls.

10. The rim board system as in claim 7, wherein the top compartment has a curved rear wall.

11. The rim board system as in claim 10, wherein said top compartment curved back wall curves outward toward the rim board front surface near said central slot.

12. The rim board system as in claim 7, wherein said bottom compartment has a curved back wall.

13. The rim board system as in claim 12, wherein said bottom compartment curved back wall curves outward toward the rim board front surface near said central slot.

14. The rim board as in claim 7, wherein said top compartment has a curved back wall and said bottom compartment has a curved back wall.

15. A method of installing a flooring or rafter system, the method comprising:

providing a rim board with a front surface having a plurality of recesses in the front surface adapted to receive a joist, wherein said recesses each comprise a top compartment with a width, a bottom compartment with a width, and a central slot extending between the top compartment and bottom compartment and having a width that is less than the widths of the top and bottom compartments;

providing a plurality of joists each having an end comprising a top flange and a bottom flange and a web connecting said top and bottom flanges; and inserting one of said joists into each of said recesses with said top and bottom flanges being received in said top and bottom compartments respectively and said web being received in said central slot, so that said end of each joist is captured by said recess.

16. A method as in claim 15, further comprising a plurality of said rim boards and connecting them end-to-end.

17. A method as in claim 15, wherein said plurality of recesses are provided in said rim board at pre-determined spacing along substantially the entire length of the rim board.

* * * * *